US007451604B2

(12) United States Patent
Yoshida et al.

(10) Patent No.: US 7,451,604 B2
(45) Date of Patent: Nov. 18, 2008

(54) DEVICE AND METHOD FOR VAPORIZING LNG

(75) Inventors: Keijiro Yoshida, Hiroshima (JP); Kazumasa Ogura, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 348 days.

(21) Appl. No.: 10/554,746

(22) PCT Filed: Mar. 8, 2005

(86) PCT No.: PCT/JP2005/003959

§ 371 (c)(1),
(2), (4) Date: Oct. 28, 2005

(87) PCT Pub. No.: WO2005/088186

PCT Pub. Date: Sep. 22, 2005

(65) Prior Publication Data

US 2006/0288711 A1 Dec. 28, 2006

(30) Foreign Application Priority Data

Mar. 10, 2004 (JP) ..... 2004-067987

(51) Int. Cl.
*F17C 9/02* (2006.01)

(52) U.S. Cl. ..... 62/50.2

(58) Field of Classification Search ..... 62/50.2
See application file for complete search history.

(56) References Cited

U.S. PATENT DOCUMENTS

| | | | | |
|---|---|---|---|---|
| 3,138,150 | A * | 6/1964 | Hyer et al. | 126/360.2 |
| 3,738,353 | A * | 6/1973 | Santoleri | 122/32 |
| 6,578,366 | B1 * | 6/2003 | Christiansen et al. | 62/50.2 |
| 6,598,408 | B1 * | 7/2003 | Nierenberg | 62/53.2 |

FOREIGN PATENT DOCUMENTS

| | | | |
|---|---|---|---|
| JP | 54-109115 | U | 8/1979 |
| JP | 59-162489 | U | 10/1984 |
| JP | 5-306890 | A | 11/1993 |
| JP | 2003-517545 | A | 5/2003 |
| JP | 2003-329198 | A | 11/2003 |

* cited by examiner

*Primary Examiner*—William C Doerrler
(74) *Attorney, Agent, or Firm*—Birch, Stewart, Kolasch & Birch, LLP

(57) ABSTRACT

An LNG gasifier configured to be installed on an offshore structure for vaporizing LNG includes a water passage into which water flows; an LNG passage provided inside the water passage and configured to pass the LNG and that allows heat exchange between the water and the LNG; and a bubble generating unit configured to generate bubbles of air into the water in the water passage. The water passage has an inlet port from where the water is taken in and a discharge port from where air and the water are discharged.

7 Claims, 4 Drawing Sheets

DEVICE AND METHOD FOR VAPORIZING LNG

BACKGROUND OF THE INVENTION

1. Field of the Invention

The present invention relates to a liquefied-natural-gas (LNG) gasifier and a method of gasification.

2. Description of the Related Art

A liquefied natural gas (LNG), which is liquid methane, is a liquid having a boiling point of about −165° C. The LNG is transported from a liquefaction station by sea with an LNG ship provided with a cryogenic tank. The LNG is handled at on-shore LNG-receiving terminals (stations) near a port of various places to be supplied to customers.

Such LNG-receiving terminals are provided with, for example, an insulated tank to hold the LNG from a ship, a gasifier (vaporizer) to vaporize the LNG to convert into a natural gas (NG), in other words, a heat exchanger, and a controlling and measuring installation that regulates and measures an amount of the LNG supplied to pipeline of a customer.

To serve the LNG at an area without such LNG-receiving terminal, a floating-production-storage-and-offloading (FPSO) vessel is proposed. The FPSO is provided with a gasifier to convert the LNG into the NG at sea. The NG converted from the LNG at sea, for example, on a ship, is supplied through a pipeline to an on-shore pipeline for NG (Patent Literature 1).

An example of an LNG gasifier on a ship is shown in FIG. 4. As shown in FIG. 4, a conventional LNG gasifier includes a pipe 2 to feed the LNG from an LNG storage tank 1. An outer surface of a pipe 2*a* is brought into contact with a heating medium such as seawater 3. The pipe 2*a* is surrounded by a tubular shell 4. A seawater pump 5 is provided inside the tubular shell 4 to send the seawater 3 through the shell 4. A motor 6 is provided in a ship 7 to drive the seawater pump 5. The NG obtained by vaporization is collected in a collection tank 8 and sent to shore by a pipe 9.

Patent Literature 1: Japanese Patent Publication No. 2003-517545

In the conventional LNG gasifier disclosed in patent literature 1, the seawater pump 5 needs to be provided inside the tubular shell 4 to supply seawater, which is used as a heat source for vaporization. This requires provision of the motor 6 to drive the seawater pump 5 as well as maintenance of the seawater pump 5.

On the other hand, when, for example an open-rack-type LNG gasifier as shown in FIG. 5 that uses seawater for heat exchange is provided in the FPSO, seawater 103 is brought into a seawater trough 101 from a seawater supply port 102. The LNG passing through a heat exchanging tube 104 is vaporized by means of the seawater 103 overflowing from the seawater trough 101. Thus, the open rack type LNG gasifier needs a stable supply of seawater. However, a stable supply of seawater from the seawater trough 101 cannot be maintained due to swaying of the ship.

Providing the FPSO with another type of LNG gasifier such as an LNG gasifier that carries out heat exchange by supplying a gas from a burner to a water cistern requires maintenance of the burner and accompanying combustion facilities. Moreover, this results in a high fuel cost.

Providing the FPSO with still another type of LNG gasifier such as an LNG gasifier that carries out heat exchange by means of an intermediate heating medium requires use of combustible liquefied-petroleum gas (LPG) or chlorofluorocarbon substitute as the intermediate medium. This causes difficult handling, for example, in inspection and maintenance.

SUMMARY OF THE INVENTION

It is an object of the present invention to solve the above problems and to provide an LNG gasifier that is simple in structure and enables stable vaporization of LNG in the FPSO, and a method of gasification.

To solve the above problems, a first aspect of the invention of the present invention includes an LNG gasifier for vaporizing LNG that includes a seawater inlet passage that is provided in a main unit and into which seawater flows; a heat exchanging tube for causing heat exchange between the seawater and the LNG, the heat exchanging tube provided inside the seawater inlet passage; a bubbling device for supplying air into the seawater, the bubbling device provided near an inlet port of the seawater inlet passage; an air supplying device configured to supply external air to the bubbling device; and a discharge port for discharging bubbling air, which is generated in the bubbling device, outside the main unit, the discharge port configured to communicate with the seawater inlet passage. The bubbling air generated in the bubbling device brings the seawater inside the inlet passage from the seawater inlet port to vaporize the LNG supplied inside the heat exchanging tube.

In a second aspect of the invention according to the first aspect of the invention, the seawater inlet passage opens in a vertical axial direction.

In a third aspect of the invention according to the first aspect of the invention, the heat exchanging tube includes a spiral shaped tube.

In a fourth aspect of the invention according to the first aspect of the invention, the heat exchanging tube includes a flange joint so that the heat exchanging tube is configured to separate into multiple parts.

In a fifth aspect of the invention according to the first aspect of the invention, the seawater inlet port is located below the discharge port.

A sixth aspect of the invention according to the present invention includes a ship that includes the LNG gasifier according to any one of the first to the fifth aspect the invention.

A seventh aspect of the invention according to the present invention includes an offshore structure that includes the LNG gasifier according to any one of the first to the fifth aspect of the invention.

An eighth aspect of the invention according to the present invention includes a method of gasification of LNG that includes causing bubbles with air inside a seawater inlet passage provided in a main unit to take in seawater inside the seawater inlet passage; and supplying LNG into a heat exchanging tube provided inside the seawater inlet passage to vaporize the LNG.

According to the present invention, it is possible to realize stable gasification of an LNG on an FPSO and an LNG gasifier having a simple structure in which a seawater pump required in a conventional LNG gasifier for supplying a heat source is not required.

DETAILED DESCRIPTION OF THE INVENTION

Exemplary embodiments of the present invention are explained in detail below with reference to the accompanying drawings. The present invention is not limited to the embodiments. Structural elements described in the embodiments include all modifications and alternative constructions, which may occur to one skilled in the art.

An LNG gasifier according to a first embodiment of the present invention is explained with reference to the accompanying drawings.

Figure 1:
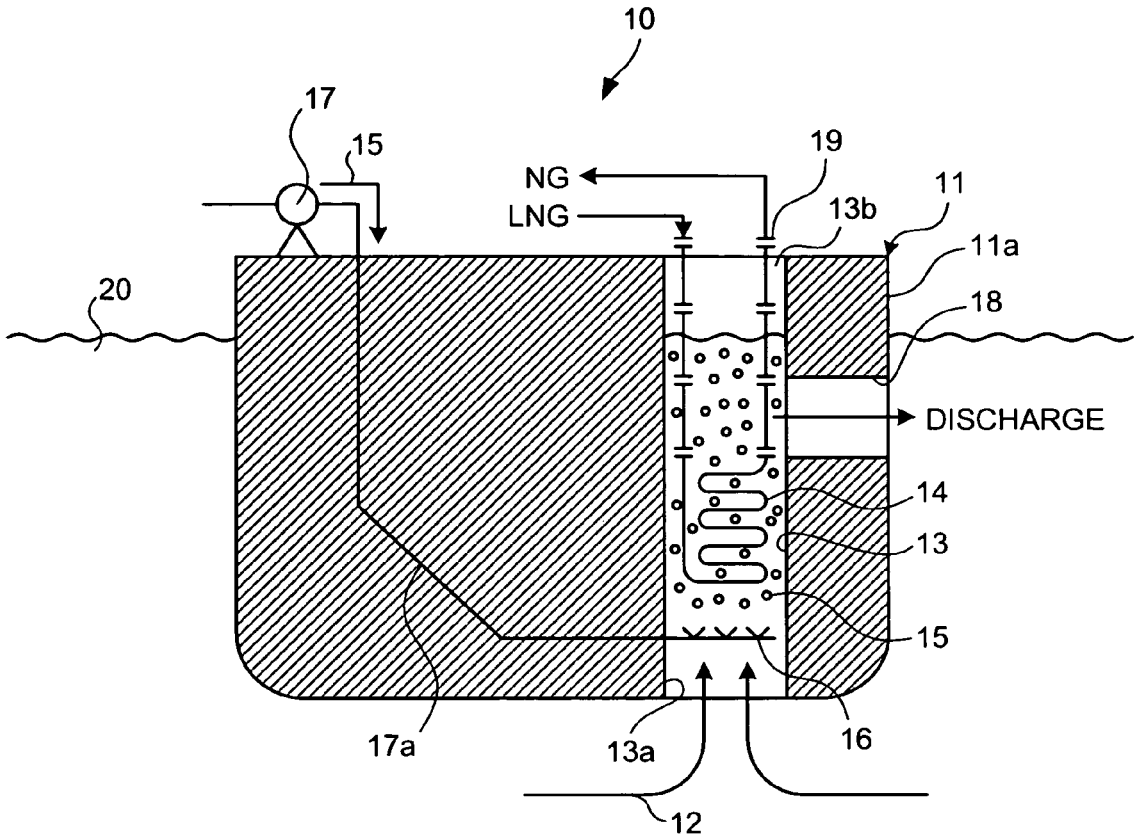
FIG. 1 is a cross-section of an LNG gasifier according to a first embodiment of the present invention.
Figure 2:
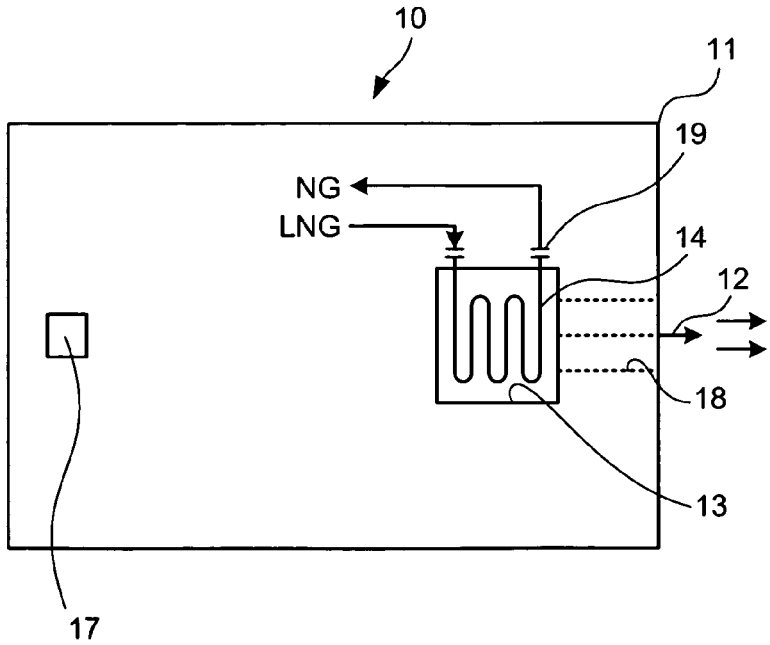
FIG. 2 is a plan view of the LNG gasifier according to the first embodiment.

FIG. 1 is a cross-section of the LNG gasifier according to the first embodiment. FIG. 2 is a plan view of the LNG gasifier.

As shown in FIG. 1 and FIG. 2, an LNG gasifier 10 for vaporizing LNG is provided in a main unit 11 immersed in sea 20. Seawater 12A is taken into a seawater inlet passage 13. A heat exchanging tube 14 is provided along an axial direction of a passage inside the seawater inlet passage 13 to cause heat exchange between the seawater 12 and LNG. A bubbling device 16 provided near a seawater inlet port 13*a* of the seawater inlet passage 13 supplies air 15 to the seawater 12. An air supplying device 17 continuously supplies the air 15 from outside to the bubbling device 16 through a passage 17*a*. Through a discharge port 18 communicating with the seawater inlet passage 13, the air 15 in a form of bubble generated in the bubbling device 16 is discharged out of the main unit 11 together with the seawater 12. The seawater 12 is forcibly brought inside the seawater inlet passage 13 through the seawater inlet port 13*a* collaterally with movement of the air 15 in bubbles generated in the bubbling device 16. Thus, the LNG supplied inside the heat exchanging tube 14 from an LNG tank is vaporized to an NG.

According to the present embodiment, the seawater inlet passage 13 is formed in such a manner that the seawater inlet passage 13 runs through in a vertical axial direction inside the main unit 11 and has a port 13*b* that communicates with the outside.

The discharge port 18 is provided on a sidewall 11*a* of the main unit 11 in such a manner that the discharge port 18 communicates with the seawater inlet passage 13 so that the bubbling air 15 is swiftly discharged.

According to the present embodiment, the heat exchanging tube 14 is, for example, a trombone-shaped spiral tube so that heat exchange efficiency is enhanced. However, the present invention is not to be thus limited, and a tube of any shape having high heat exchange efficiency may be applied.

According to the present embodiment, the heat exchanging tube 14 includes a flange joint 19 and is separable into multiple parts. Thus, the heat exchanging tube 14 can be separated or connected when the heat exchanging tube 14 is to be inserted into or removed from the seawater inlet passage 13, thereby making insertion or removal of the heat exchanging tube easier.

According to the present embodiment, the seawater inlet port 13*a* is located below the discharge port 18, thereby increasing efficiency in supplying seawater and increasing the heat exchange efficiency.

According to the present embodiment, the air supplying device 17 supplies air to the bubbling device 16, and an airlift force of the bubbling causes the seawater 12 to be brought inside the seawater inlet passage 13. Then, LNG is supplied into the heat exchanging tube 14. Thus, heat exchange is caused between the LNG and the seawater 12 to vaporize the LNG into NG.

According to the present embodiment, providing the LNG gasifier, for example, to a ship to be an FPSO, it is possible to realize a stable vaporization of LNG. Thus, an LNG gasifier that has a simple structure in which a seawater pump for supplying a heat source, which is required in a conventional LNG gasifier, is not required can be provided.

According to the present embodiment, the seawater is forcibly brought into the seawater inlet passage by supplying air to the bubbling device. Unlike the conventional technology, a heat source such as a burner is not needed, and use of an intermediate medium (LNG or chlorofluorocarbon substitute) is not required. Thus, inspection and maintenance can be easily carried out, and a stable supply of seawater can be maintained without being affected by swaying of the ship at sea.

Second Embodiment

A ship provided with an LNG gasifier according to a second embodiment of the present invention is explained with reference to the accompanying drawings.

Figure 3:
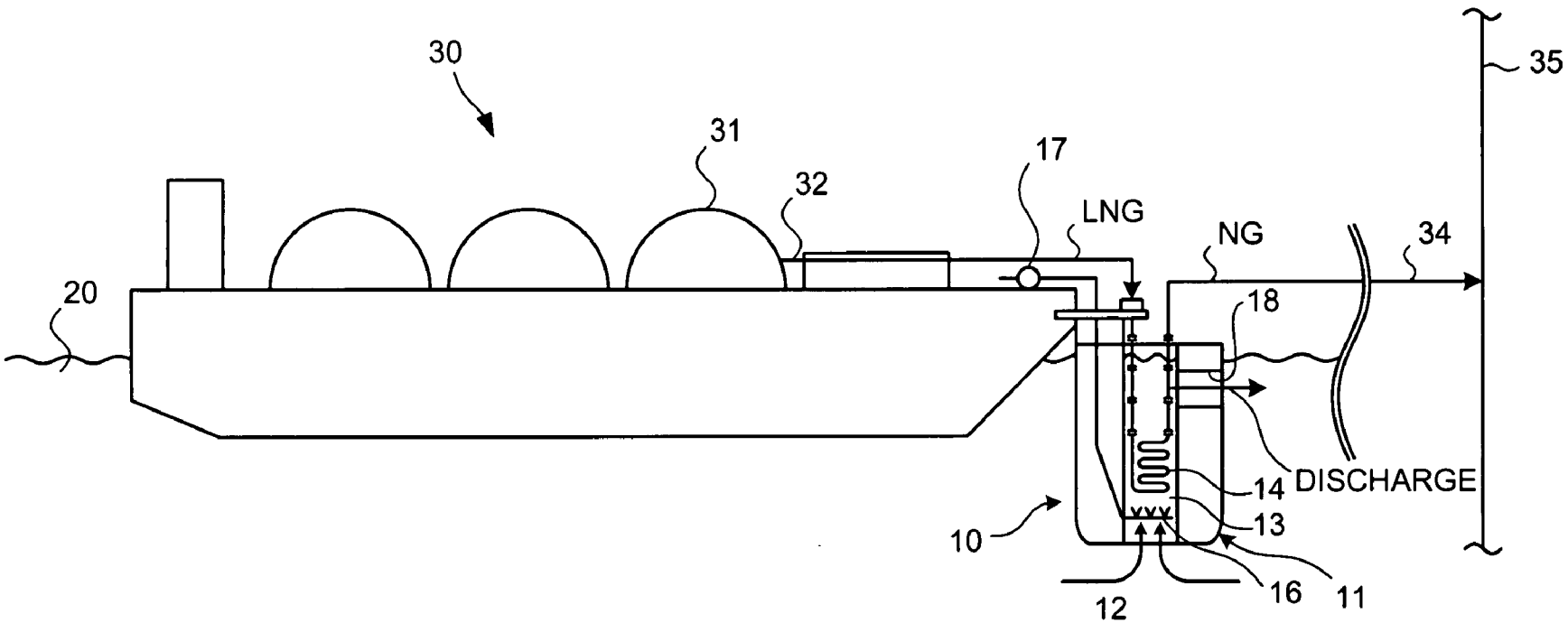
FIG. 3 is a schematic of a ship provided with the LNG gasifier according to a second embodiment of the present invention.
Figure 4:
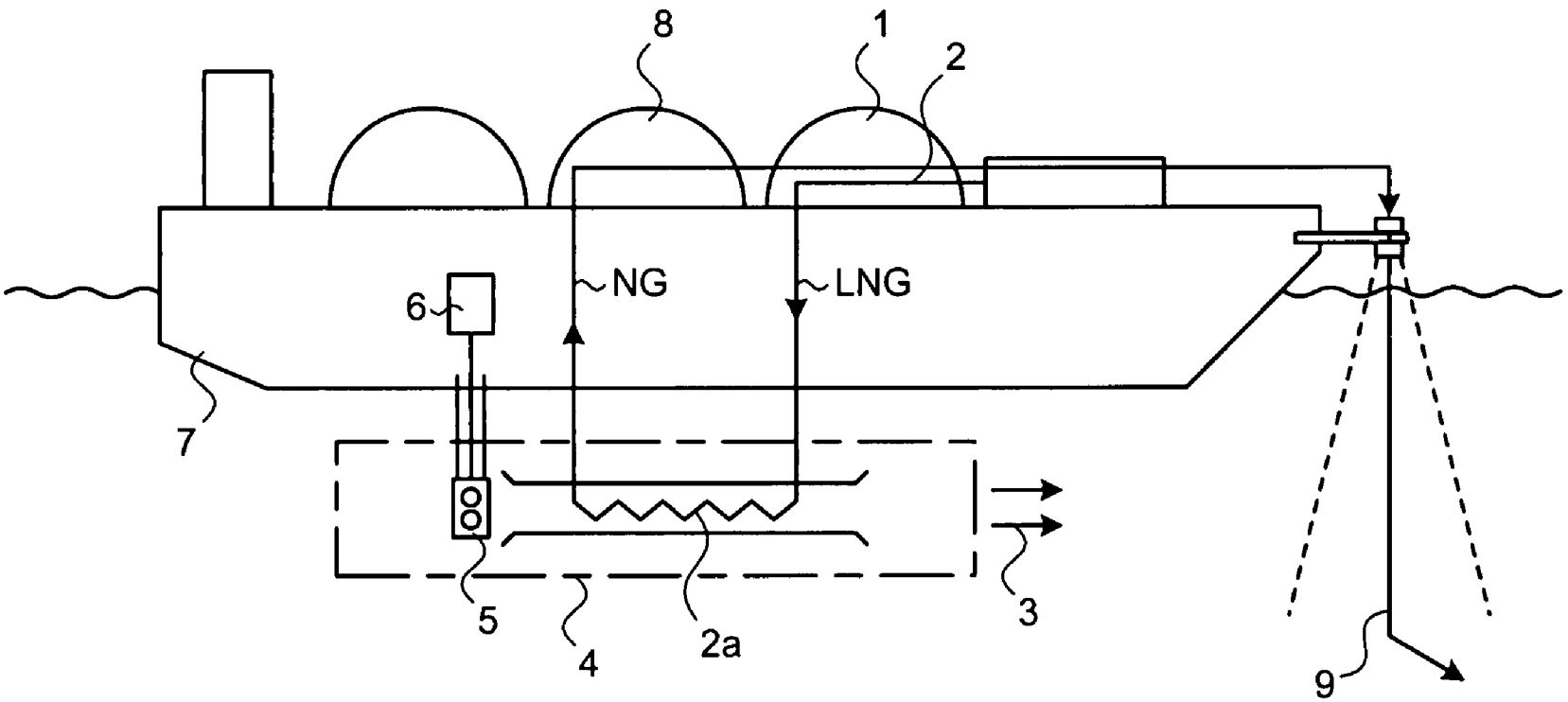
FIG. 4 is a schematic of an LNG gasifier according to a conventional technology.
Figure 5:
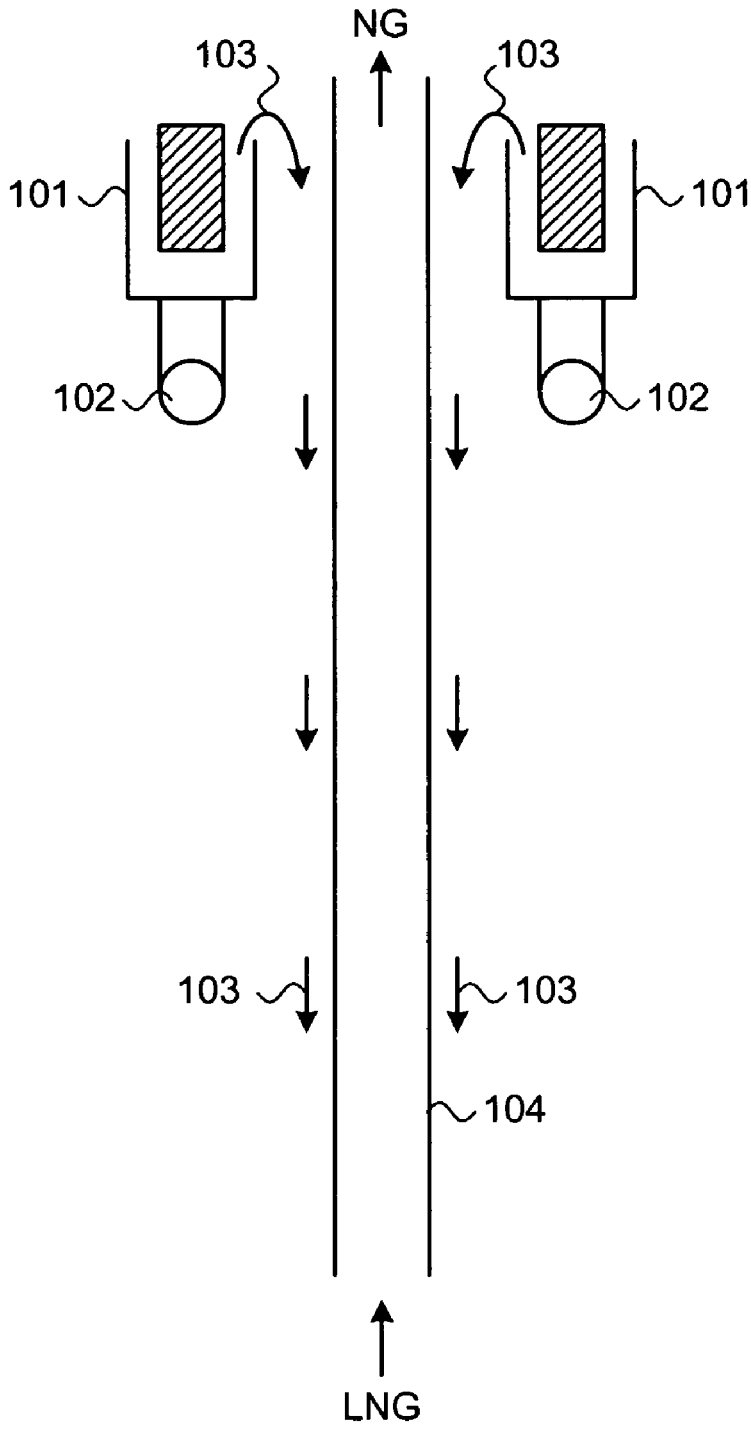
FIG. 5 is a schematic of another LNG gasifier according to a conventional technology.

FIG. 3 is a schematic of the ship provided with the LNG gasifier according to the second embodiment.

As shown in FIG. 3, the LNG gasifier 10 is arranged at a bow of a ship 30 according to the present embodiment. The LNG supplied from an LNG tank 31 via a pipe 32 is vaporized in the LNG gasifier 10 and supplied to an on-shore pipeline 35 via a pipeline 34.

Thus, LNG can be stably vaporized and supplied as NG even to a place on the shore without an LNG receiving terminal. Moreover, the NG supplied can be directly supplied to the on-shore pipeline.

According to the present embodiment, it is possible to vaporize the LNG with a simple structure using the LNG gasifier arranged at the bow of the ship, and to directly supply the NG obtained by vaporization to the on-shore pipeline.

While in the present embodiment, the LNG gasifier shown in FIG. 1 is provided on the ship, the present invention is not thus limited and the LNG gasifier may also be provided on a marine structure located offshore.

Moreover, while in the present embodiment, the seawater is used to vaporize the LNG, the present invention is not thus limited, and other liquid media, for example, water may be used.

INDUSTRIAL APPLICABILITY

The LNG gasifier and method for LNG gasification according to the present invention can be applied to ships or offshore structures that include an LNG gasifier.

The invention claimed is:

1. A liquefied natural gas (LNG) gasifier configured to be installed on an offshore structure for vaporizing LNG, comprising:

a water passage into which water flows, the water passage having an inlet port from where the water is taken in and a discharge port from where the water is discharged, the discharge port being located below a surface of the water;

an LNG passage provided inside the water passage and configured to pass the LNG and that allows heat exchange between the water and the LNG; and a bubble generating unit configured to generate bubbles of air into the water in the water passage below the discharge port, the bubbles providing the motive force to move the water past the LNG passage, wherein the water passage is substantially perpendicular to the surface of water on which the offshore structure floats.

2. The LNG gasifier according to claim 1, wherein the LNG passage includes a spiral tube.

3. The LNG gasifier according to claim 1, wherein the LNG passage is configured to separate into multiple parts.

4. The LNG gasifier according to claim 1, wherein the bubble generating unit is provided inside the water passage near the inlet port.

5. An offshore structure, comprising:

an LNG gasifier that includes, a water passage into which water flows, wherein the water passage has an inlet port from where the water is taken in and a discharge port from where the water is discharged, the inlet port being located below the discharge port, and the discharge port being located below a surface of water on which the offshore structure floats;

an LNG passage provided inside the water passage and configured to pass the LNG and that allows heat exchange between the water and the LNG; and a bubble generating unit configured to generate bubbles of air into the water in the water passage below the discharge port, the bubbles providing the motive force to move the water past the LNG passage, wherein the water passage is substantially perpendicular to the surface of water on which the offshore structure floats.

6. The offshore structure according to claim 5, wherein the offshore structure includes a ship.

7. A method of gasification of LNG, comprising:

providing, on an offshore structure, a water passage having a water passage having a discharge port, from which the water is discharged and which is located below a surface of the water, and an inlet port from which the water is taken in and which is located below the discharge port, the bubbles being generated in the water below the discharge port, the water passage being substantially perpendicular to the surface of water on which the offshore structure floats;

generating bubbles of air in water inside the water passage the bubbles providing the motive force to move the water through the water passage; and passing LNG into an LNG passage provided inside the water passage and that allows heat exchange between the water and the LNG.

* * * * *